United States Patent [19]

Snyder

[11] 4,024,654

[45] May 24, 1977

[54] ROOF SNOW SCOOP DEVICE

[75] Inventor: Wayne M. Snyder, Castor, Canada

[73] Assignee: The Raymond Lee Organization, Inc., New York, N.Y. ; a part interest

[22] Filed: Sept. 13, 1976

[21] Appl. No.: 722,347

[52] U.S. Cl. ..... 37/53; 294/54; 15/236 R

[51] Int. Cl.[2] ..... E01H 5/02; A47L 13/02

[58] Field of Search ..... 37/53; 294/54; 15/236 R; 37/115

[56] References Cited

UNITED STATES PATENTS

| | | | |
|---|---|---|---|
| 2,603,892 | 7/1952 | Fischer | 37/53 |
| 2,632,263 | 3/1953 | Cooper | 37/53 X |
| 3,218,738 | 11/1965 | Bowerman | 37/53 |
| 3,483,643 | 12/1969 | Wenzel | 294/54 X |
| 3,773,375 | 11/1973 | Nehls | 37/53X |

FOREIGN PATENTS OR APPLICATIONS

| | | | |
|---|---|---|---|
| 90,509 | 10/1957 | Norway | 37/53 |
| 536,043 | 4/1941 | United Kingdom | 294/55 |

*Primary Examiner*—E. H. Eickholt
*Attorney, Agent, or Firm*—Daniel Jay Tick

[57] ABSTRACT

A manual snow plow blade has a C-type cross-section, a pair of spaced parallel linear upper and lower edges and a pair of spaced opposite ends. A pair of rings are affixed to corresponding ends of the blade in a manner whereby the rings are in parallel planes perpendicular to the blade and extend beyond the borders of the blade. A planar sheet member is affixed to the rings at the upper edge of the blade. A first pulling device is affixed to the blade intermediate the upper and lower edges on the convex surface thereof for manually pulling the device up the incline of a sloping roof whereby only the rings abut the roof thereby preventing the uprooting of shingles on the roof. A second pulling device is affixed to the planar sheet member for manually pulling the device down the incline thereby causing the lower edge of the blade to bite into snow on the roof whereby the blade pulls snow down the incline with it.

2 Claims, 5 Drawing Figures

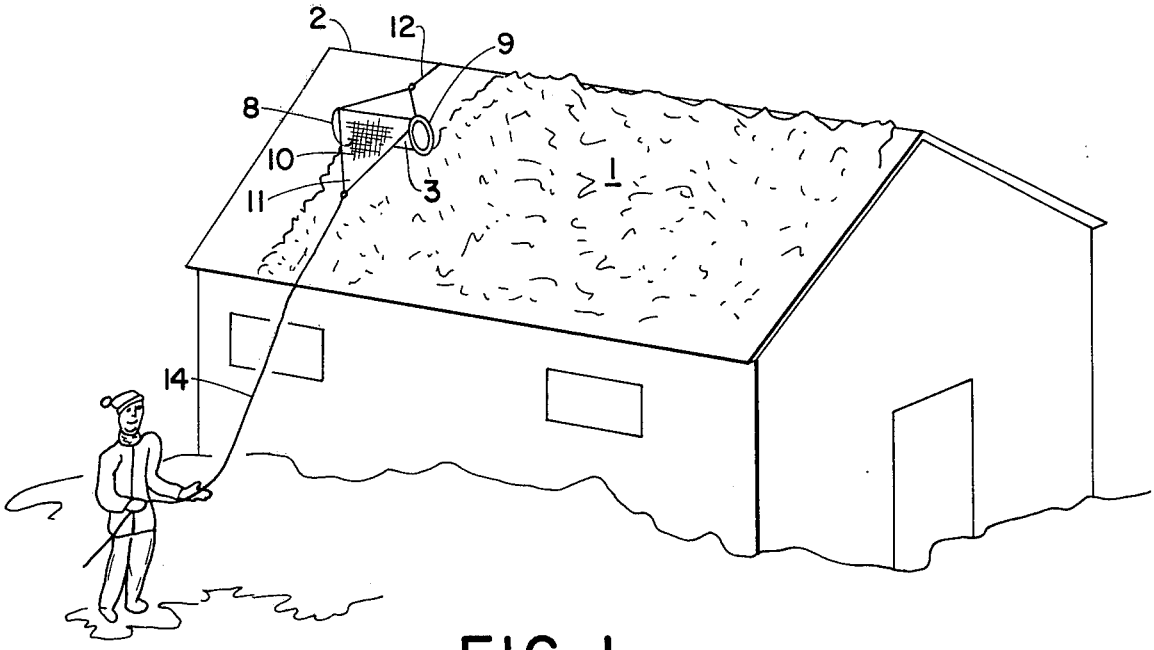
FIG. 1
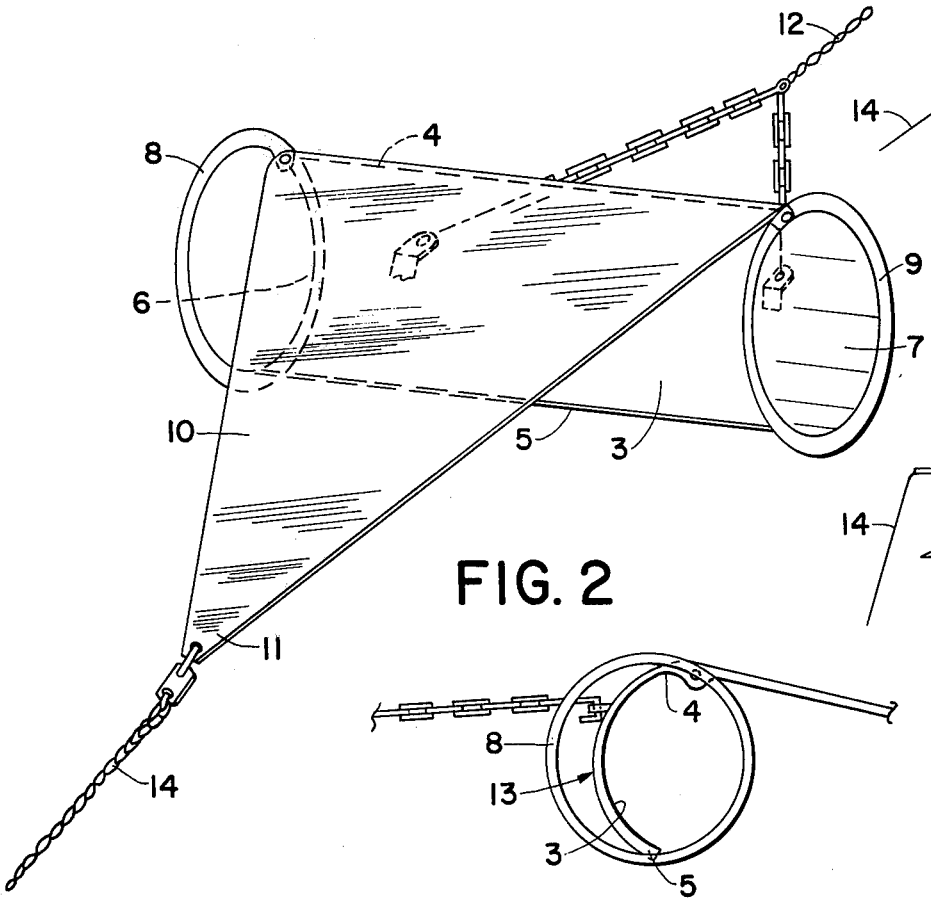
FIG. 2
FIG. 3
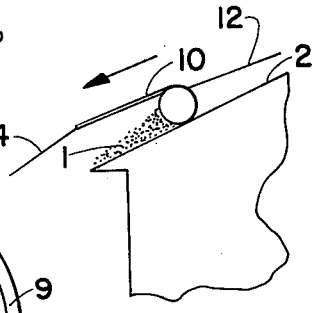
FIG. 4
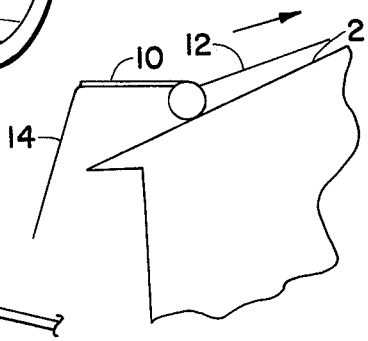
FIG. 5

ROOF SNOW SCOOP DEVICE

BACKGROUND OF THE INVENTION

The present invention relates to a roof snow scoop device. More particularly, the invention relates to a roof scoop device for removing snow from a sloping roof.

Objects of the invention are to provide a roof snow scoop device of simple structure, which is inexpensive in manufacture, used with facility and convenience, and functions efficiently, effectively and reliably to remove snow from a sloping roof safely and rapidly.

BRIEF DESCRIPTION OF THE DRAWINGS:

In order that the invention may be readily carried into effect, it will now be described with reference to the accompanying drawings, wherein:

FIG. 1 is a perspective view of an embodiment of the roof snow scoop device of the invention in use;

FIG. 2 is a perspective view, on an enlarged scale, of an embodiment of the roof snow scoop device of the invention;

FIG. 3 is an axial end view of the embodiment of FIG. 2;

FIG. 4 is a schematic diagram illustrating the pulling of the device of the invention down the slope of a roof; and FIG. 5 is a schematic diagram illustrating the pulling of the device of the invention up the slope of a roof.

DETAILED DESCRIPTION OF THE INVENTION

The roof snow scoop device of the invention removes snow 1 from a sloping roof 2 (FIGS. 1 and 4).

The snow scoop device of the invention comprises a manual snow plow blade 3 (FIGS. 1 to 3) having a substantially C-type cross-section, a pair of spaced parallel substantially linear upper and lower edges 4 and 5, respectively (FIGS. 2 and 3), and a pair of spaced opposite ends 6 and 7 (FIG. 2).

A pair of rings 8 and 9 (FIGS. 1 and 2) are affixed to the ends 6 and 7, respectively, of the blade 3 in a manner whereby the rings are in parallel substantially perpendicular to the blade and extend beyond the borders of said blade, as shown in the FIGS.

A substantially planar sheet member 10 (FIGS. 1 to 5) of any suitable material such as, for example, metal, plastic, or the like, is affixed to the rings 8 and 9 at the upper edge 4 of the blade 3. The planar sheet member 10 is of substantially triangular configuration having an apex 11 (FIGS. 1 and 2) spaced from the blade 3.

A first pulling device 12 such as, for example, a chain, rope, cable, or the like (FIGS. 1 to 5) is affixed to the blade 3 intermediate the upper and lower edges 4 and 5 on the convex surface 13 thereof (FIG. 3) for manually pulling the device up the incline of the sloping roof 2, as shown in FIG. 5, whereby only the rings 8 and 9 abut the roof thereby preventing the uprooting of shingles on the roof.

A second pulling device 14 such as, for example, a chain, rope, cable, or the like (FIGS. 1, 2, 4 and 5), is affixed to the apex 11 of the planar sheet member 10 for manually pulling the device down the incline of the roof 2 thereby causing the lower edge 5 of the blade 3 to bite into the snow 1 on the roof, as shown in FIGS. 1 and 4, whereby the blade pulls snow down the incline with it.

While the invention has been described by means of a specific example and in a specific embodiment, I do not wish to be limited thereto, for obvious modifications will occur to those silled in the art without departing from the spirit and scope of the invention.

I claim:

1. A roof snow scoop device for removing snow from a sloping roof, said snow scoop device comprising a manual snow plow blade having a substantially C-type cross-section, a pair of spaced parallel substantially linear upper and lower edges and a pair of spaced opposite ends;

a pair of rings affixed to corresponding ends of the blade in a manner whereby the rings are in parallel planes substantially perpendicular to the blade and extend beyond the borders of said blade;

a substantially planar sheet member affixed to the rings at the upper edge of the blade;

first pulling means affixed to the blade intermediate the upper and lower edges on the convex surface thereof for manually pulling the device up the incline of a sloping roof whereby only the rings abut the roof thereby preventing the uprooting of shingles on the roof; and second pulling means affixed to the planar sheet member for manually pulling the device down said incline thereby causing the lower edge of the blade to bite into snow on the roof whereby the blade pulls snow down said incline with it.

2. A roof snow scoop device as claimed in claim 1, wherein the planar sheet member is of substantially triangular configuration having an apex spaced from the blade, and the second pulling means is affixed to said apex.

* * * * *